US011702914B1

(12) United States Patent
Al Majid et al.

(10) Patent No.: US 11,702,914 B1
(45) Date of Patent: Jul. 18, 2023

(54) SAND FLUSHING ABOVE BLANKING PLUG

(71) Applicant: SAUDI ARABIAN OIL COMPANY, Dhahran (SA)

(72) Inventors: Hussain Al Majid, Saihat (SA); Jawad M. Al Khalifah, Sayhat (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/707,554

(22) Filed: Mar. 29, 2022

(51) Int. Cl.

| | |
|---|---|
| ***E21B 43/12*** | (2006.01) |
| ***E21B 33/12*** | (2006.01) |
| ***E21B 37/00*** | (2006.01) |
| ***E21B 21/00*** | (2006.01) |
| ***E21B 37/08*** | (2006.01) |
| ***E21B 31/03*** | (2006.01) |

(52) U.S. Cl.
CPC ..... *E21B 43/128* (2013.01); *E21B 33/12* (2013.01); *E21B 37/00* (2013.01); *E21B 21/00* (2013.01); *E21B 31/03* (2013.01); *E21B 37/08* (2013.01)

(58) Field of Classification Search
CPC ..... E21B 43/128; E21B 33/12; E21B 37/00; E21B 21/00; E21B 31/03; E21B 37/08
See application file for complete search history.

(56) References Cited

U.S. PATENT DOCUMENTS

| | | | | |
|---|---|---|---|---|
| 2,561,980 A * | 7/1951 | Cranberry | ..... | E21B 43/12 166/158 |
| 2,929,452 A * | 3/1960 | Ford | ..... | E21B 31/03 166/301 |
| 2,935,130 A * | 5/1960 | Moore | ..... | E21B 31/03 166/301 |
| 3,020,957 A * | 2/1962 | Tausch | ..... | E21B 37/00 166/301 |

(Continued)

OTHER PUBLICATIONS

Modahi, Mazen H., "The Importance of Electrical Submersible Pumps (ESPs) In Maximizing Oil Recovery"; Submitted in partial fulfilment of the requirements for the degree of Master of Engineering; Major Subject: Petroleum Engineering; Dalhousie University; pp. ii-67; Jul. 2012 (81 pages).

*Primary Examiner* — Blake Michener
*Assistant Examiner* — Neel Girish Patel
(74) *Attorney, Agent, or Firm* — Osha Bergman Watanabe & Burton LLP

(57) ABSTRACT

A system for producing fluids from a wellbore extending from a well surface to a fluid-producing formation has a Y-tool installed in fluid communication with the tubing string placed in the wellbore. A pump, which may be an electric submersible pump (ESP), is installed in the Y-tool for lifting fluids from the formation to the surface. A blanking plug is positioned in the tubing string between the upper and lower connections of the Y-tool. A flushing port extends through a wall of the tubing string, positioned above and near the upper end of the blanking plug when in its (Continued)

operating position, and a flushing tube is located in the annular space between the tubing string and the wellbore casing. The flushing tube is in fluid communication with the flushing port and extends from the flushing port to the well surface. Flushing fluid is pumped downhole through the flushing tube to agitate and disperse any accumulated sand, scale and other particulate matter on top of the blanking plug.

6 Claims, 5 Drawing Sheets

(56) References Cited

U.S. PATENT DOCUMENTS 3,785,690 A * 1/1974 Hutchinson ..... E21B 31/002 166/99
3,809,161 A * 5/1974 Carothers ..... E21B 31/03 166/99
4,185,690 A * 1/1980 Kinney ..... E21B 34/102 166/183
4,450,907 A * 5/1984 Clark ..... E21B 37/00 166/312
4,637,468 A * 1/1987 Derrick ..... E21B 43/116 166/313
4,678,037 A * 7/1987 Smith ..... E21B 29/02 166/299
4,898,244 A 2/1990 Schneider et al.
5,417,285 A * 5/1995 Van Buskirk ..... E21B 33/127 166/292
6,216,788 B1 * 4/2001 Wilson ..... E21B 43/38 166/105.1
6,241,021 B1 * 6/2001 Bowling ..... E21B 41/0042 166/380
6,814,144 B2 11/2004 Jones
7,111,677 B2 9/2006 St. Clair
7,431,093 B2 * 10/2008 Bearden ..... E21B 41/02 166/372
8,316,938 B2 11/2012 Al-Jarri et al.
9,097,093 B1 8/2015 Frost
10,422,199 B1 * 9/2019 Subbaraman ..... E21B 33/1208
10,584,571 B2 3/2020 Leitch
11,149,524 B2 10/2021 Reed et al.
2002/0157829 A1 * 10/2002 Davis ..... E21B 43/045 166/380
2003/0188869 A1 * 10/2003 Tinker ..... E21B 31/00 166/99
2004/0060698 A1 * 4/2004 Ravensbergen ..... E21B 37/06 166/305.1
2004/0060707 A1 * 4/2004 Bearden ..... E21B 41/02 166/380
2004/0159444 A1 * 8/2004 Wolters ..... E21B 17/028 166/50
2005/0230121 A1 * 10/2005 Martinez ..... E21B 43/124 166/372
2010/0258293 A1 * 10/2010 Lynde ..... E21B 23/00 166/66.4
2011/0024119 A1 * 2/2011 Wolf ..... E21B 34/06 166/99
2012/0111636 A1 * 5/2012 Steele ..... E21B 7/061 175/75
2013/0213655 A1 * 8/2013 Martinez ..... E21B 43/114 166/55
2017/0114636 A1 * 4/2017 Krüger ..... E21B 49/081
2018/0223624 A1 * 8/2018 Fripp ..... E21B 34/063
2018/0223642 A1 * 8/2018 Zahran ..... E21B 43/08
2019/0136660 A1 * 5/2019 King ..... E21B 33/13
2020/0340332 A1 * 10/2020 Anderson ..... E21B 37/08

* cited by examiner

SAND FLUSHING ABOVE BLANKING PLUG

BACKGROUND

In hydrocarbon well development, it is common practice to use electric submersible pumping systems (ESPs) as a primary form of artificial lift. A challenge with ESP operations is sand and solids precipitation and deposition on top of the ESP string. In order to reduce the need to remove the ESP from the wellbore in order to perform well intervention operations downhole, a Y-tool bypass assembly is employed in which the ESP is positioned in the bypass section in order to allow access to the wellbore section.

During the production phase, a blanking plug is installed in the wellbore at the Y-tool in order to prevent fluid circulation around the ESP and resulting ESP shutdown due to a variety of possible causes. Such a blanking plug must be removed from the wellbore each time a well intervention operation is performed. However, the blanking plug creates different challenges during retrieval due to the associated sand and scale accumulation on top of the plug body. Accumulating solid compositions can include one or more types of sand and scale, such silica ($SiO_2$), calcium carbonate ($CaCO_3$), calcium sulfate ($CaSO_4$), strontium sulfate ($SrSO_4$), dolomite ($CaMg(CO_3)_2$), and corrosion products and the like.

In addition, deposition of solids can result in an increase in ESP trips due to motor high temperature and overload. Motor electrical shorts can occur due to scale and corrosion buildup in the pump forcing the motor to work harder and exceed its designed rating. Moreover, as adequate flow of produced fluid past the motor is required for cooling, solids blockage of a pump's flow path above the ESP and solids build up around the outside of the motor may lead to rapid motor internal heat rise, insulation breakdown and electrical short. Some ESP wells cannot restart after a shutdown due to shaft rotation restriction from solids build up between the shaft and radial bearings, therefore requiring a workover to change out the ESP.

Accordingly, there exists a need for preventing or minimizing sand and scale accumulation on top of the blanking plug used in association with an ESP. There is also a need for eliminating or reducing the need for high cost sand/scale removal operations from the top of the blanking plug, which causes delay and increased non-productive time during well intervention operations. Moreover, there exists a need for preventing or minimizing sand and scale accumulation around the ESP shaft, thereby reducing ESP failures due to sand/scale accumulation, and overcome additional pressure drop during oil well production startup.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a fluid tank for use in association with an ESP in an oil well. Such a fluid tank may contain water, diesel oil, or another fluid. When run downhole in a wellbore in which an ESP string has been installed in conjunction with a Y-tool, to a position above and closely adjacent to the top of a blanking plug positioned generally between the upper and lower ports of the Y-tool, fluid may be dumped from the fluid tank so as to agitate and displace sand, scale, and other particulate matter from the top of the blanking plug. Such displacement of sand, scale, and other particulate matter facilitates subsequent retrieval of the blanking plug by conventional slickline tools and methods.

In another aspect, the fluid tank as just described may contain unpressurized or pressurized fluid, and the lower end of the fluid tank may be equipped with one or more generally downwardly directed nozzles or jetting orifices for accelerating the dumped fluid against the accumulated sand, scale, or particulate matter on top of the blanking plug.

In another aspect of the disclosure, an assembly including a Y-tool and ESP is provided with a flushing tube. The tube is positioned inside the wellbore in the annular space between the wall of the wellbore and the production tubing string, and extends from the surface of the well to an upper portion of the tubing string near the upper end of the Y-tool. The flushing tube is in fluid communication with the interior of the tubing string/Y-tool/ESP assembly at a relative position above and closely adjacent to a location where the upper end of an installed blanking plug is situated during production operations. Whenever retrieval and removal of the blanking plug is necessary or desired, water, diesel oil, or other fluid may be pumped from the surface through the flushing tube. Upon exiting the flushing tube, such pumped fluid will agitate and displace sand, scale, and other particulate matter that may have accumulated on top of the blanking plug. Once such a flushing operation has been performed, retrieval of the blanking plug by conventional slickline tools and methods is more easily accomplished.

In a further aspect of the disclosure, in an embodiment that includes provision of a flushing tube as just described, periodic flushing of accumulated sand, scale, and other particulate matter on top of the blanking plug may be performed at any desired interval during production operations.

Other aspects and advantages of the claimed subject matter will be apparent from the following description and the appended claims.

BRIEF DESCRIPTION OF DRAWINGS

The following figures are included to illustrate certain aspects of the embodiments, and should not be viewed as exclusive embodiments. The subject matter disclosed is amenable to considerable modifications, alterations, combinations, and equivalents in form and function, as will occur to those skilled in the art and having the benefit of this disclosure.

DETAILED DESCRIPTION

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the level of skill of persons having ordinary skill in the relevant art.

The present disclosure relates to blanking plugs used in conjunction with electrical submersible pumps (ESPs) used in hydrocarbon development operations. More specifically, the disclosure relates to blanking plugs with improved capability to minimize problems in well intervention operations caused by accumulation of sand and other solids on top of blanking plugs.

As will be made clear in the following detailed description of the embodiments of the present disclosure, at least one of the following advantages and benefits may be provided or achieved: prevention or minimization of sand and scale accumulation on top of the ESP blanking plug; elimination or reduction of the need for high cost sand/scale fill removal operations; provision of wellbore accessibility for vital well intervention operations; provision of simplified sand/scale sample collection for subsequent lab analysis thus improved scale mitigation planning; protection of ESP integrity and prolonged ESP run life; prevention of sand accumulation around the ESP shaft; reduction of ESP failures due to sand/scale accumulation; minimization of additional pressure drop during oil well startup operations.

An embodiment of the disclosure incorporates a customized wireline assembly including a tank containing a flushing liquid that can be dumped on top of a blanking plug for flushing away sand, scale, and other accumulated particulates from the top of the plug.

Figure 1:
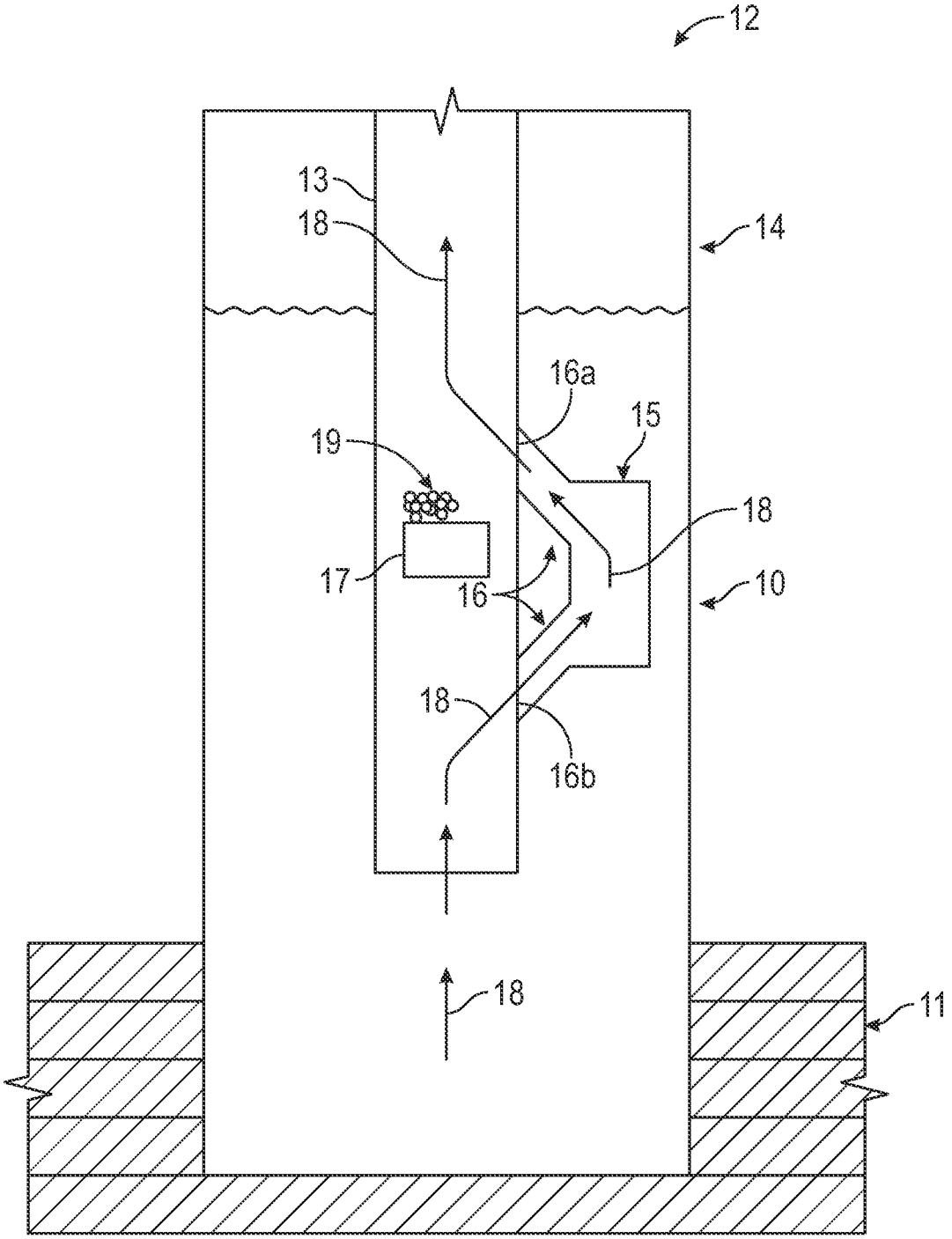
FIG. 1 is a schematic illustration of a liquid petroleum well equipped with an ESP in a Y-tool in fluid communication with a production tubing string, and an associated blanking plug positioned in the tubing string, in accordance with one or more embodiments.

As illustrated schematically in FIG. 1, an oil well 10 generally provides for extraction of petroleum and other wellbore fluids from a formation 11 in the earth and transport of such fluids to the surface 12 of the well 10. The well 10 can an offshore well or a land-based well and can be used for producing hydrocarbons from subterranean hydrocarbon reservoirs.

In construction of the well 10, production tubing string 13 is positioned within the casing 14 of the well 10. In an embodiment of this disclosure, a system for providing artificial lift to wellbore fluids includes a pump 15, which is an electrically submersible pump (ESP), submerged in wellbore fluids and in fluid communication with the tubing string 13 extending within the wellbore. The ESP 15 can be, for example, a rotary pump such as a centrifugal pump. The ESP 15 could alternatively be a progressing cavity pump, which has a helical rotor that rotates within an elastomeric stator or other type of pump known in the art for use in an ESP.

The ESP is oriented to selectively boost a pressure of the wellbore fluids traveling from the formation 11 of the well 10 towards the earth's surface 12, as is well known and conventional in the art, so that wellbore fluids can travel more efficiently to the earth's surface 12.

During production operations, access to the formation 11 from the surface 12 is occasionally required. In order to avoid the necessity of withdrawing the ESP from the tubing 13 each time such access is necessary, the ESP is positioned in a Y-tool 16 adjacent to, outside of, and in fluid communication with the tubing string 13, as is known in the relevant art. In order to prevent recirculation of fluids lifted by the ESP 15 back down the tubing 13, a blanking plug 17 is positioned in the tubing 13 adjacent and between the upper and lower passages or connections 16*a*,16*b*, respectively, of the Y-tool 16 to the tubing string 13. While tubing string 13 is schematically illustrated as being vertical in FIG. 1, it will be understood by persons having ordinary skill in the art that the tubing string 13 may have an orientation other than vertical; thus, the terms "upper" and "lower" in the description of this embodiment are intended to signify relative positions rather than physical directions. More particularly, the "upper" Y-tool connection 16*a* to the tubing 13 is simply the connection closer to the surface 12 of the well 10, and the "lower" Y-tool connection 16*b* is closer to the distal end of the tubing string 13 located in the formation 11.

Further during production operations, the ESP lifts fluids in a flow direction 18 and path from the formation 11 through the tubing 13, into the Y-tool 16 via the lower connection 16*b*, through the ESP 15, out the Y-tool 16 via the upper connection 16*a* back into the tubing string 13 and to the surface 12 of the well 10. In addition to desirable fluids, however, sand 19 which may be silica ($SiO_2$), calcium carbonate ($CaCO_3$), calcium sulfate ($CaSO_4$), strontium sulfate ($SrSO_4$), dolomite ($CaMg(CO_3)_2$), and other scale, particulates, and corrosion products may also be entrained in the fluids and are also lifted by and through the ESP 15. Upon reentry of the fluids via the upper Y-tool connection 16*a* into the tubing 13 above or past the blanking plug 17, such sand 19 and scale and other particulates tend to settle on top of the blanking plug 17.

If not addressed in some way, such as by embodiments of the present disclosure, sand 19 (which will be understood to possibly include scale and or other particulates, for the purposes of this disclosure) may accumulate to such a degree and amount that retrieval of the blanking plug 17 is very difficult or, in extreme cases, nearly impossible. A blanking plug is typically provided with a conventional fishing neck at its upper end, for receiving and connecting to a conventional wireline fishing tool, as is known in the pertinent art. When sufficient amounts of sand 19 have accumulated on top of the fishing neck, it may become impossible for the fishing tool to enter, connect to, or otherwise engage the fishing neck of the plug 17, thus preventing retrieval and removal of the blanking plug 17 from the tubing string 13.

In addition, accumulation of sand 19 on top of the blanking plug 17 may also cause sand and scale to also accumulate within the ESP 15 itself and, more particularly, around the shaft of the pumping mechanism within the ESP 15, which may reduce ESP run life and integrity and, consequently, lead to premature pump failures.

Figure 2:
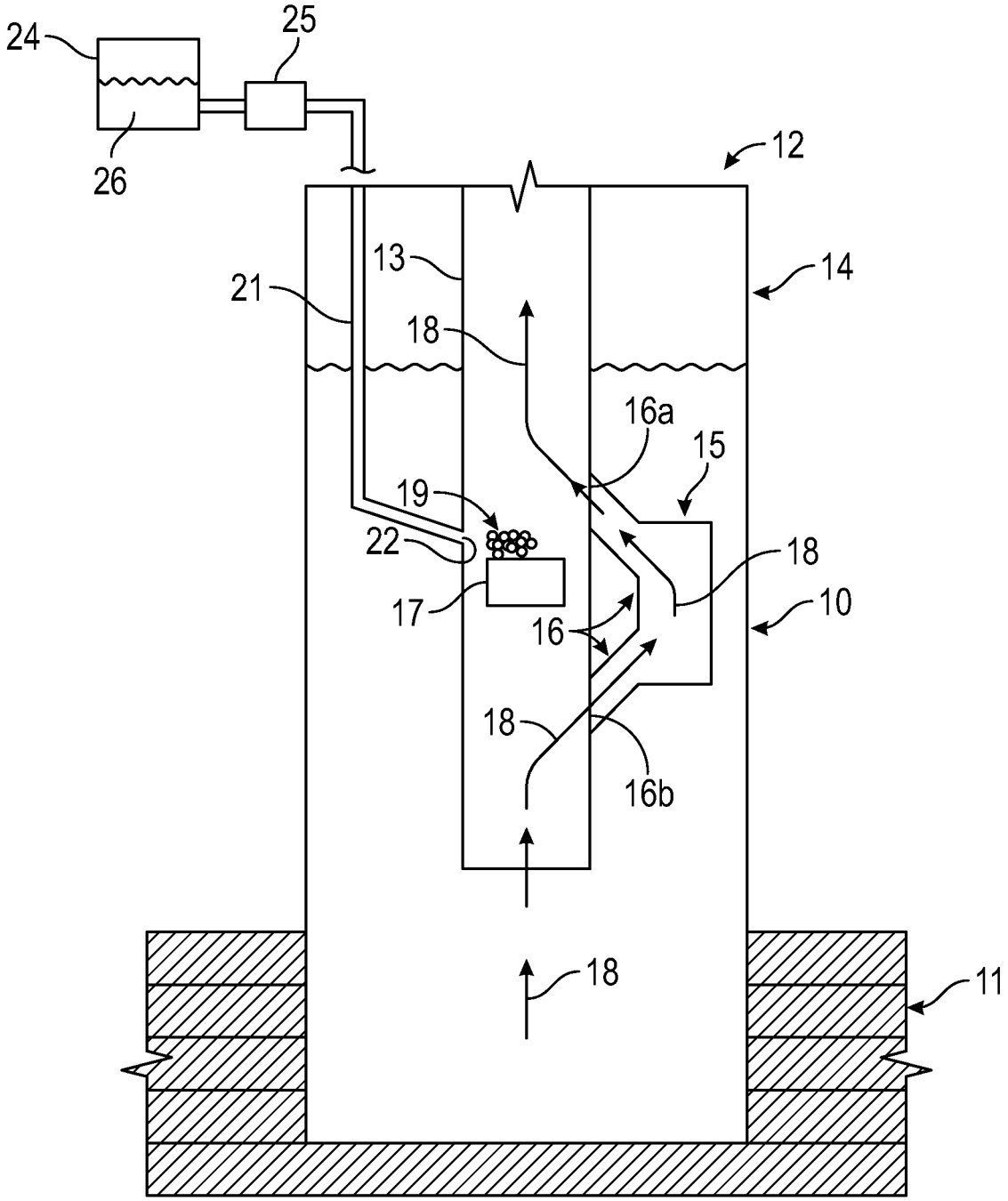
FIG. 2 is a schematic illustration of an embodiment of a liquid petroleum well equipped with an ESP in a Y-tool in fluid communication with a production tubing string, and further provided with an embodiment of a flushing tube.

Referring now to FIG. 2, an embodiment is disclosed wherein a flushing tube 21 extends from the surface 12 to the production tubing 13 at a position adjacent to or near the Y-tool 16 where the blanking plug 17 is conventionally positioned during production operations. More specifically, the tube 21 is positioned in the annular space between the well casing 14 and the tubing string 13. The flushing tube 21 terminates at a flushing port 22 in the wall of the tubing 13 just above the upper end of the blanking plug 17 when the blanking plug 17 is in its installed position. When it is necessary or desired to retrieve the blanking plug 17 using typical slickline or wireline equipment, as is conventionally done for a number of reasons, water or diesel oil or other flushing fluids may be pumped from the surface 12 down flushing tube 21. Upon exiting the tube 21 via the flushing port 22 into the production tubing 13, such fluids will agitate and disperse the sand 19 that has settled on top of the plug 17. Removal or dispersal of such materials from the top of the blanking plug 17 facilitates connection of a conventional slickline or wireline connector to the fishing neck of the blanking plug 17.

Figure 3:
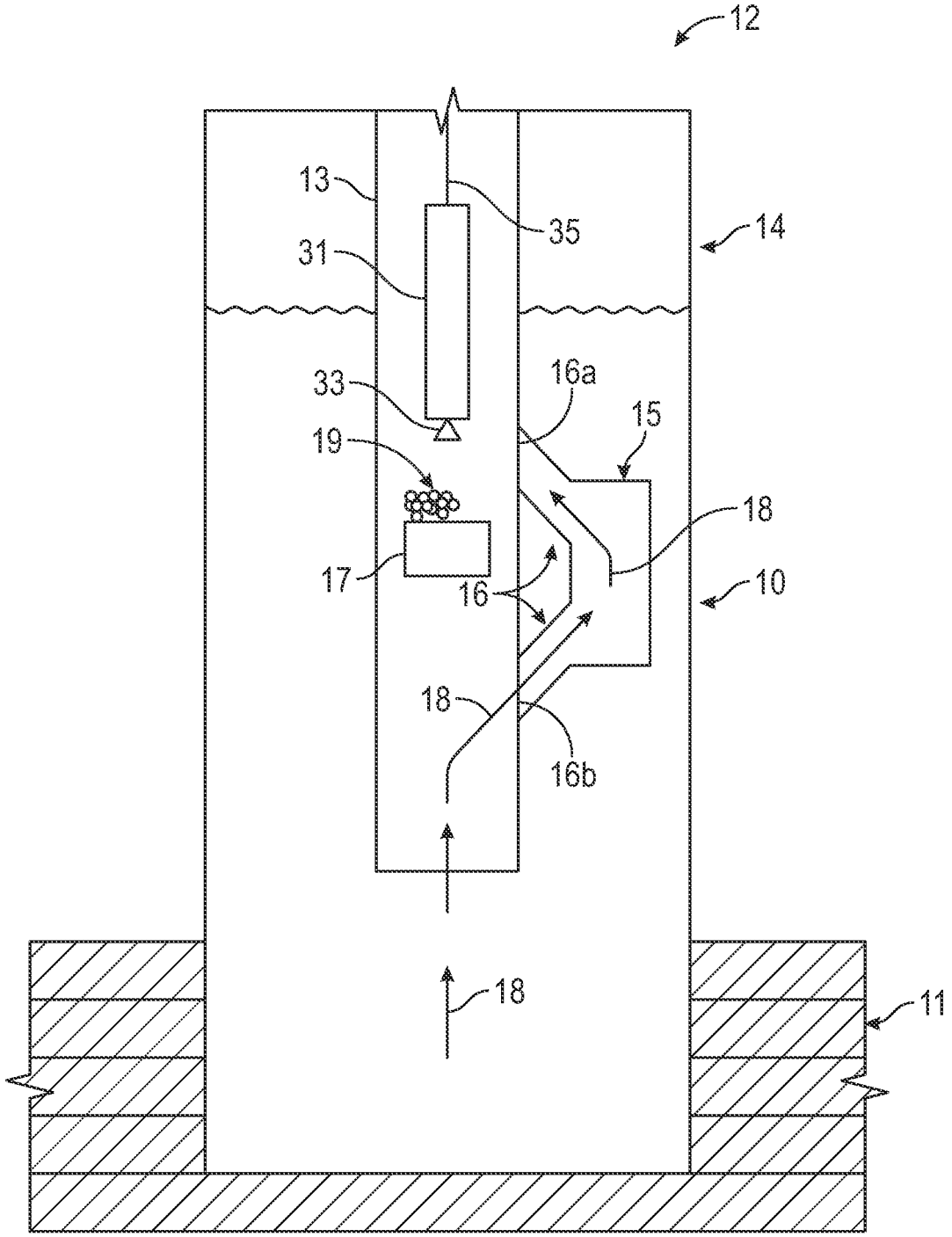
FIG. 3 is a schematic illustration of an embodiment of a fluid tank useful in conjunction with the well depicted in FIG. 1.

According to the embodiment of FIG. 3, no modification of the production tubing 13 is necessary for clearing accumulated sand 19 on top of the blanking plug 17. Instead, a fluid tank 31 filled with water, diesel oil, or other flushing fluids is lowered by slickline 35, wireline, or other conventional techniques to a position just above the blanking plug 17. The fluid within the tank 31 may be pressurized or unpressurized. The tank 31 is equipped with a generally downwardly directed nozzle 33 or similar orifice at its lower end.

When the tank 31 is positioned with the nozzle 33 just above and closely adjacent to the top of the blanking plug 17, the flushing fluids contained within the tank 31 are dumped onto the accumulated sand 19, resulting in agitation and dispersal of such materials. Actuation of the fluid dumping operation may be accomplished by any suitable valve mechanism which may be operated mechanically, electrically, hydraulically, or by any other type of control system.

After the flushing fluid has been dumped, the tank 31 will be retrieved and withdrawn from the production tubing 13, and a conventional fishing neck connector may be lowered to retrieve the blanking plug 17 via its fishing neck from which accumulated sand 19 has been removed.

Figure 4:
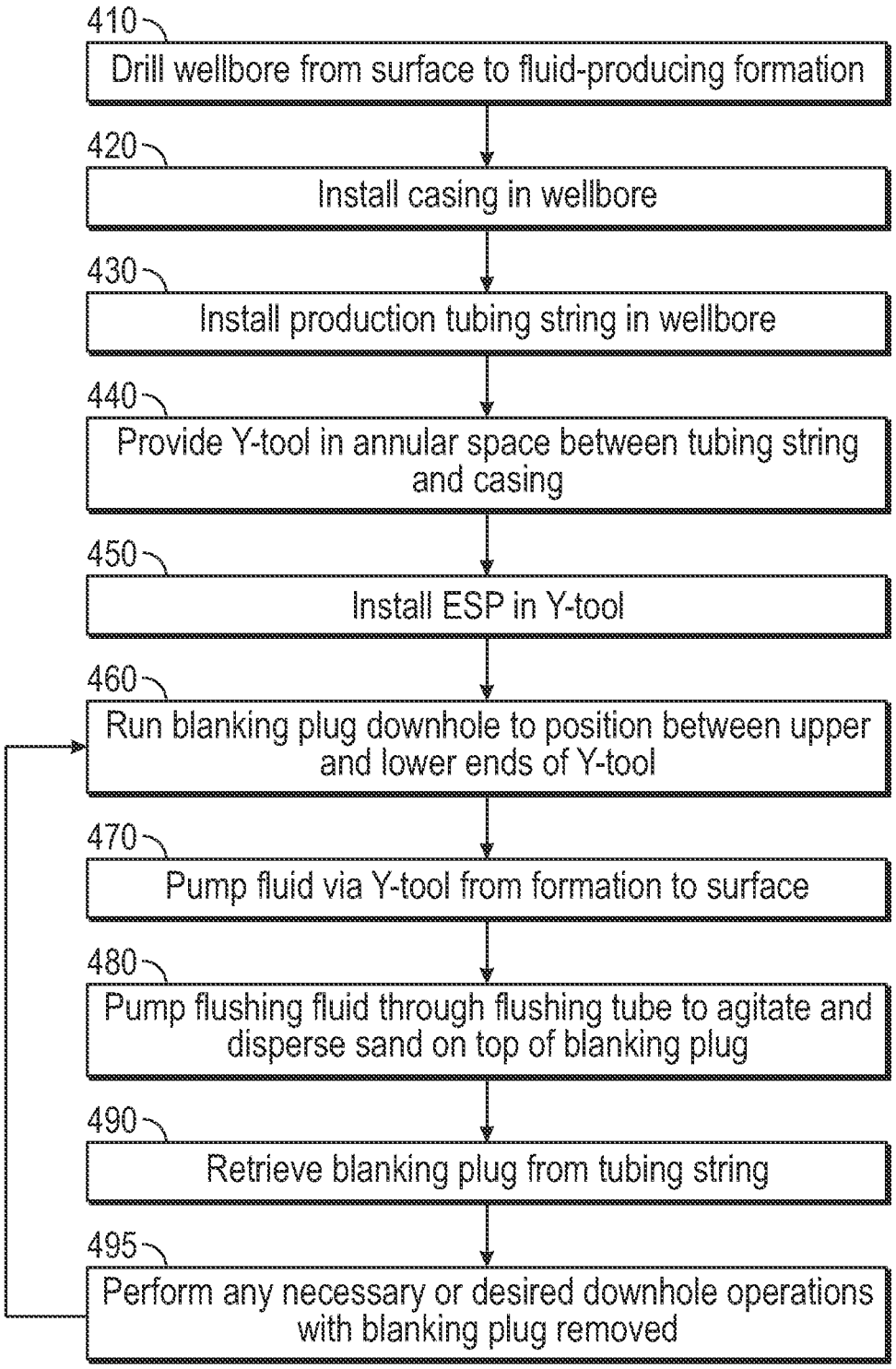
FIG. 4 is a flowchart of an embodiment of a disclosed method for fluid production operations of a well.

According to the embodiment of FIG. 4, a method of producing fluids from a fluid-producing formation 11 in the earth is shown. A wellbore is drilled from a surface 12 of the earth to a fluid-producing formation 11 in the earth (STEP 410) in any conventional manner. Likewise, in any conventional manner wellbore casing 14 is installed (STEP 420) followed by installation of a production tubing string 13 (STEP 430) extending into the fluid-producing zone 11 of the formation. An annular space is provided between the tubing string 13 and the wellbore casing 14 in known fashion.

A Y-tool 16 having upper and lower connections 16*a*,16*b* to the tubing string 13 is provided in the annular space (STEP 440) and a pump 15, which may be an ESP, is installed in the Y-tool 16 (STEP 450). These steps may be performed in any desired and convenient order, for example, by first providing a subassembly comprising a section of production tubing having an ESP-fitted Y-tool connected thereto, and then incorporating such subassembly into the tubing string during installation of the tubing string.

According to an embodiment of the disclosure relating to provision of a subassembly comprising a section of production tubing having an ESP-fitted Y-tool connected thereto, as just described, such section of tubing will also be fitted or otherwise provided with a flushing port 22 extending through the wall of the tubing string 13 for connection to a flushing tube 21 positioned in the annular space and extending from the flushing port 22 to the surface 12 of the well 10. The upper end of the flushing tube 21 may be connected to a tank 24 filled with water, diesel oil, or other flushing fluids 26, directly or via a pump 25 for pumping the flushing fluids 26 downhole through the flushing tube 21.

A blanking plug 20 is next run downhole via wireline, slickline, or any other suitable manner, to a working position located between the upper and lower connections 16*a*,16*b* of the Y-tool 16 (STEP 460). Fluids are then pumped by the ESP 15 via the Y-tool 16 from the fluid-producing formation 11 to the surface 12 of the well 10 (STEP 470).

After a period of pumping hydrocarbon or other desired fluids from the formation, it may be necessary or desired to remove the blanking plug from the tubing string for any of a number of reasons. Flushing fluids will be sent down the flushing tube 21 and directed through the flushing port 22 onto the top of the blanking plug 17, thereby agitating and dispersing any accumulated sand 19 on top of the plug (STEP 480).

A GS style or any other appropriate pulling tool is run downhole to mate with and attach to the fishing neck of the blanking plug 17, in conventional manner. The blanking plug 17 is then withdrawn from the tubing string 13 (STEP 490). Next, after any necessary or desired downhole operations have been completed (STEP 495), the blanking plug 17 is again run downhole to its downhole position adjacent the Y-tool 16 (STEP 460) and pumping operations are resumed (STEP 470). After another period of pumping, the sand flushing step (STEP 480) may be repeated as often as necessary or desired, the process repeating in iterative fashion.

Figure 5:
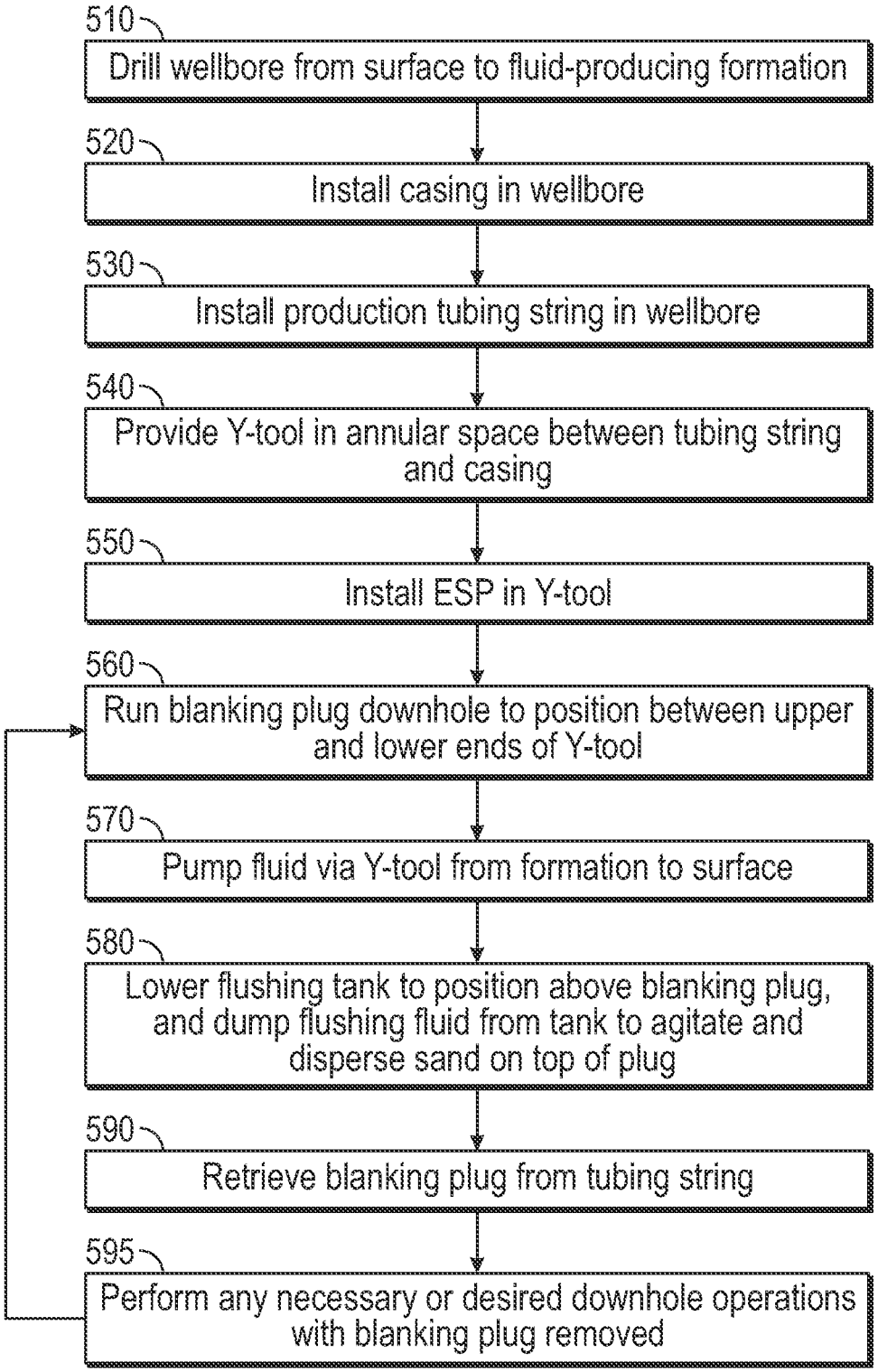
FIG. 5 is flowchart of another embodiment of a disclosed method for fluid production operations of a well.

According to another embodiment of the disclosure illustrated in FIG. 5, a method of producing fluids from a fluid-producing formation 11 in the earth is shown. A wellbore is drilled from a surface 12 of the earth to a fluid-producing formation 11 in the earth (STEP 510) in any conventional manner. Likewise, in any conventional manner wellbore casing 14 is installed (STEP 520) followed by installation of a production tubing string 13 (STEP 530) extending into the fluid-producing zone 11 of the formation. An annular space is provided between the tubing string 13 and the wellbore casing 14 in known fashion.

A Y-tool 16 having upper and lower connections 16*a*,16*b* to the tubing string 13 is provided in the annular space (STEP 540) and a pump 15, which may be an ESP, is installed in the Y-tool 16 (STEP 550). These steps may be performed in any desired and convenient order, for example, by first providing a subassembly comprising a section of production tubing having an ESP-fitted Y-tool connected thereto, and then incorporating such subassembly into the tubing string during installation of the tubing string.

A blanking plug 17 is next run downhole via wireline, slickline, or any other suitable manner, to a working position located between the upper and lower connections 16*a*,16*b* of the Y-tool 16 (STEP 560). Fluids are then pumped by the ESP 15 via the Y-tool 16 from the fluid-producing formation 11 to the surface 12 of the well 10 (STEP 570).

After a period of pumping hydrocarbon or other desired fluids from the formation, it may be necessary or desired to remove the blanking plug 17 from the tubing string 13 for any of a number of reasons. Tank 31 containing flushing fluids will be run downhole to a position just above the upper end of the plug 17. Once so positioned, the flushing fluids, which may optionally be contained in the tank 31 under pressure, are dumped via one or more nozzles 33 or orifices in the lower end of the tank 31 onto the top of the blanking plug 17, thereby agitating and dispersing any accumulated sand 19 on top of the plug (STEP 580).

A GS style or any other appropriate pulling tool is run downhole to mate with and attach to the fishing neck of the blanking plug 17, in conventional manner. The blanking plug 17 is then withdrawn from the tubing string 13 (STEP 590). Next, after any necessary or desired downhole operations have been completed (STEP 595), the blanking plug 17 is again run downhole to its downhole position adjacent the Y-tool 16 (STEP 560) and pumping operations are resumed (STEP 570). After another period of pumping, the sand flushing step (STEP 580) may be repeated as often as necessary or desired, the process repeating in iterative fashion.

Although only a few exemplary embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A system for producing fluids from a fluid-producing formation in the earth comprising:

a wellbore extending from a well surface to the fluid-producing formation, the wellbore having a casing therein;

a tubing string positioned in the wellbore;

a Y-tool having upper and lower connections in fluid communication with the tubing string;

a pump connected to the Y-tool for pumping fluid from the lower connection to the upper connection of the Y-tool;

a blanking plug having an upper end and a downhole end, positioned in the tubing string between the upper and lower connections of the Y-tool;

a flushing port extending through a wall of the tubing string and positioned above and near the upper end of the blanking plug;

a flushing tube positioned in an annular space between the tubing string and the casing, the flushing tube in fluid communication with the flushing port and extending from the flushing port to the well surface.

2. The system of claim 1, further comprising:

a tank of flushing fluid located at the well surface, the tank being connected to and in fluid communication with the flushing tube.

3. The system of claim 2, further comprising:

a pump located at the well surface, the pump connected to and in fluid communication with both the flushing tube and the tank.

4. The system of claim 3, wherein the pump connected to the Y-tool is an electric submersible pump (ESP).

5. A method of producing fluids from a fluid-producing formation in the earth, comprising the steps:

drilling a wellbore from a surface to the fluid-producing formation;

installing a casing in the wellbore;

installing a production tubing string in the wellbore, providing an annular space between the casing and the tubing string;

providing a flushing tube in the annular space and extending from the surface to a flushing port through the wall of the tubing string;

providing a Y-tool in the annular space and having upper and lower connections in fluid communication with the tubing string;

installing a pump in the Y-tool for pumping fluid from the lower connection to the upper connection of the Y-tool;

providing a blanking plug having an upper end and a downhole end;

running the blanking plug down the tubing string to a first position between the upper and lower connections of the Y-tool, wherein the flushing port is positioned above and near the upper end of the blanking plug when the plug is at the first position;

pumping fluid containing sand from the formation to the surface via the Y-tool;

after a period of accumulation of sand on top of the blanking plug, pumping flushing fluid through the flushing tube to agitate and disperse the accumulated sand;

retrieving and withdrawing the blanking plug from the tubing string;

performing downhole operations while the blanking plug is withdrawn from the tubing string;

re-running the blanking plug down the tubing string to the first position; and resuming pumping fluid containing sand from the formation to the surface via the Y-tool.

6. The method of producing fluids according to claim 5, wherein the pump is an electric submersible pump (ESP).

* * * * *